US011034917B2

(12) United States Patent
Nakajima et al.

(10) Patent No.: US 11,034,917 B2
(45) Date of Patent: Jun. 15, 2021

(54) HARD SURFACE DETERGENT COMPOSITION

(71) Applicant: NICCA CHEMICAL CO., LTD., Fukui (JP)

(72) Inventors: Junichi Nakajima, Fukui (JP); Masahiko Shimakawa, Fukui (JP); Fumitaka Ito, Fukui (JP)

(73) Assignee: NICCA CHEMICAL CO., LTD., Fukui (JP)

( * ) Notice: Subject to any disclaimer, the term of this patent is extended or adjusted under 35 U.S.C. 154(b) by 70 days.

(21) Appl. No.: 15/554,610

(22) PCT Filed: Feb. 29, 2016

(86) PCT No.: PCT/JP2016/056117
§ 371 (c)(1),
(2) Date: Aug. 30, 2017

(87) PCT Pub. No.: WO2016/140200
PCT Pub. Date: Sep. 9, 2016

(65) Prior Publication Data

US 2018/0237727 A1 Aug. 23, 2018

(30) Foreign Application Priority Data

Mar. 5, 2015 (JP) ..... JP2015-043561

(51) Int. Cl.

| | |
|---|---|
| ***C11D 3/20*** | (2006.01) |
| ***C11D 3/37*** | (2006.01) |
| ***C11D 3/30*** | (2006.01) |
| ***C11D 9/22*** | (2006.01) |
| ***C11D 3/43*** | (2006.01) |
| ***C11D 9/26*** | (2006.01) |
| ***C11D 9/30*** | (2006.01) |

(52) U.S. Cl.
CPC ..... *C11D 3/2079* (2013.01); *C11D 3/201* (2013.01); *C11D 3/202* (2013.01); *C11D 3/2013* (2013.01); *C11D 3/2065* (2013.01); *C11D 3/30* (2013.01); *C11D 3/3757* (2013.01); *C11D 3/3765* (2013.01); *C11D 3/43* (2013.01); *C11D 9/225* (2013.01); *C11D 9/26* (2013.01); *C11D 9/30* (2013.01)

(58) Field of Classification Search
CPC ..... C11D 3/2079; C11D 3/3757
See application file for complete search history.

(56) References Cited

U.S. PATENT DOCUMENTS

| | | | | | |
|---|---|---|---|---|---|
| 4,065,409 | A * | 12/1977 | Flanagan | C11D 1/62 | 510/423 |
| 4,565,547 | A * | 1/1986 | Takada | C10L 1/10 | 44/334 |
| 5,472,629 | A * | 12/1995 | Lysy | C11D 1/83 | 510/238 |
| 5,507,971 | A * | 4/1996 | Ouzounis | C11D 3/3765 | 510/424 |
| 5,710,120 | A * | 1/1998 | Kanluen | C11D 1/83 | 510/421 |
| 5,929,016 | A * | 7/1999 | Harrison | A01N 33/12 | 510/199 |
| 6,100,231 | A * | 8/2000 | Cheung | C11D 1/75 | 510/433 |
| 6,277,805 | B1 * | 8/2001 | Kupneski | C11D 1/62 | 510/384 |
| 6,342,473 | B1 * | 1/2002 | Kott | C11D 1/22 | 510/357 |
| 6,903,064 | B1 * | 6/2005 | Kasturi | C11D 3/0026 | 424/70.11 |
| 2002/0103098 | A1 * | 8/2002 | Harrison | C11D 1/86 | 510/382 |
| 2009/0029895 | A1 * | 1/2009 | Scialla | C11D 3/3796 | 510/180 |
| 2009/0176687 | A1 * | 7/2009 | Tjelta | C11D 3/3761 | 510/445 |
| 2009/0191248 | A1 * | 7/2009 | Hoffman | A61K 8/43 | 424/402 |
| 2011/0294899 | A1 * | 12/2011 | Lang | B01D 19/0404 | 514/674 |
| 2012/0316097 | A1 * | 12/2012 | Maeyama | C11D 3/30 | 510/259 |
| 2014/0343157 | A1 * | 11/2014 | Griese | A01N 33/12 | 514/642 |

(Continued)

FOREIGN PATENT DOCUMENTS

| | | | |
|---|---|---|---|
| CN | 1344310 | A | 4/2002 |
| CN | 101203595 | A | 6/2008 |

(Continued)

OTHER PUBLICATIONS

JP-06313198 A. An English Translation. (Year: 1994).*

(Continued)

*Primary Examiner* — Nicole M. Buie-Hatcher
*Assistant Examiner* — M. Reza Asdjodi
(74) *Attorney, Agent, or Firm* — Leydig Voit & Mayer, Ltd.

(57) ABSTRACT

The cleaning agent composition for hard surface contains (A) at least one kind of carboxylic acid compound selected from the group consisting of an aliphatic monocarboxylic acid, a polycarboxylic acid, and any neutralized salt of these, (B) an alkanolamine compound, and (C) a hydroxyl group-containing compound having from 8 to 50 carbon atoms.

13 Claims, No Drawings

(56) References Cited

U.S. PATENT DOCUMENTS

| | | | | |
|---|---|---|---|---|
| 2016/0024436 | A1* | 1/2016 | Vetter | C11D 3/0036 510/528 |
| 2018/0237727 | A1* | 8/2018 | Nakajima | C11D 3/30 |

FOREIGN PATENT DOCUMENTS

| | | | | | |
|---|---|---|---|---|---|
| CN | 102770522 | A | | 11/2012 | |
| CN | 104245912 | A | | 12/2014 | |
| JP | 60-18596 | A | | 1/1985 | |
| JP | 6-313198 | A | | 11/1994 | |
| JP | 06313198 | A | * | 11/1994 | F02B 77/04 |
| JP | H11-500180 | A | | 1/1999 | |
| JP | 2000-282085 | A | | 10/2000 | |
| JP | 2003-521563 | A | | 7/2003 | |
| JP | 2008-297507 | A | | 12/2008 | |
| JP | 2009-052006 | A | | 3/2009 | |
| JP | 2009-084621 | A | | 4/2009 | |
| JP | 2011-093216 | A | | 5/2011 | |
| JP | 2011-132381 | A | | 7/2011 | |
| JP | 2014-29020 | A | | 2/2014 | |
| JP | 2014029020 | A | * | 2/2014 | C11D 1/825 |
| JP | 5638057 | B2 | | 12/2014 | |
| WO | WO 97/19155 | A1 | | 5/1997 | |
| WO | WO 00/43478 | A1 | | 7/2000 | |
| WO | WO 2011/105449 | A1 | | 9/2011 | |

OTHER PUBLICATIONS https://www.masterorganicchemistry.com/2010/10/25/3-trends-that-affect-boiling-points/James Ashenhurst Branching, and Its Affect On Melting and Boiling Points. (Year: 2019).*

Japan Patent Office, Office Action in counterpart Japanese Patent Application No. P2015-043561, dated Jan. 8, 2019.

International Searching Authority, International Preliminary Report on Patentability in Counterpart International Application No. PCT/JP2016/056117, dated Sep. 14, 2017.

Chinese Patent Office, Office Action in counterpart Chinese Patent Application No. 201680004140.3, dated Dec. 5, 2018.

International Bureau, International Search Report in International Application No. PCT/JP2016/056117, dated May 24, 2016.

Japanese Patent Office, Office Action in counterpart Japanese Patent Application No. P2015-043561, dated May 28, 2019.

Chinese Patent Office, Office Action in counterpart Chinese Patent Application No. 201680004140.3, dated Aug. 23, 2019.

* cited by examiner

HARD SURFACE DETERGENT COMPOSITION

CROSS-REFERENCE TO RELATED APPLICATIONS

This patent application is the U.S. National Stage of International Application No. PCT/JP2016/056117, filed Feb. 29, 2016, which claims the benefit of Japanese Application No. 2015-043561, filed Mar. 5, 2015, which are each incorporated by reference.

TECHNICAL FIELD

The present invention relates to a cleaning agent composition to be used for cleaning a hard surface.

BACKGROUND ART

In recent years, domestic parts makers are exposed to intense cost competition as parts markets of automobiles, trains, airplanes, machine tools, and the like have been globalized and low-priced parts have been introduced into the markets. For these reasons, each parts manufacturer has taken various cost saving measures in the materials and manufacturing process in order to maintain the competitive power.

As one example of cost saving measures in the manufacturing process, the temperature for the cleaning step has been lowered to normal temperature. By performing parts cleaning which has been performed at a relatively high temperature at normal temperature, the cleaning bath is not required to be heated and the energy cost saving is thus expected, but there is a problem that the performance to be originally required to the cleaning step such as detergency deteriorates.

When the amount of cleaning agent is increased in order to compensate for the detergency, not only the cost saving itself is not achieved as the cost of chemicals increases but also a number of troubles in the process occur so that bubbles generated in the cleaning bath by an increase in the amount of chemicals used overflow from the bathtub.

It has been hitherto investigated to improve the cleaning performance and foam inhibiting property of cleaning agent. For example, the following Patent Literature 1 discloses a metal cleaning agent composition containing two specific kinds of nonionic surfactants. In addition, the following Patent Literature 2 discloses a metal cleaning agent containing a specific ionic surfactant, a specific amine compound, an aminocarboxylic acid-based chelating agent, and a carboxylic acid in combination.

CITATION LIST

Patent Literature

Patent Literature 1: Japanese Unexamined Patent Publication No. 2009-84621

Patent Literature 2: Japanese Unexamined Patent Publication No. 2011-132381

SUMMARY OF INVENTION

Technical Problem

As the performance of the cleaning agent required in the cleaning step, there is one that the cleaning agent hardly remains on the parts after being cleaned. However, the liquid does not sufficiently drop from the parts and the energy cost for drying the parts increases in the case of the conventional cleaning agents described above.

The present invention has been made in view of the above circumstances, and an object thereof is to provide a cleaning agent composition for hard surface which exhibits excellent liquid dropping property.

Solution to Problem

In order to solve the above problems, the present invention provides a cleaning agent composition for hard surface containing (A) at least one kind of carboxylic acid compound selected from the group consisting of an aliphatic monocarboxylic acid, a polycarboxylic acid, and any neutralized salt of these, (B) an alkanolamine compound, and (C) a hydroxyl group-containing compound having from 8 to 50 carbon atoms.

The cleaning agent composition for hard surface of the present invention can be a cleaning agent exhibiting excellent liquid dropping property as it has the configuration described above.

In the cleaning agent composition for hard surface of the present invention, it is preferable that the hydroxyl group-containing compound is an aliphatic monoalcohol or a phenol derivative represented by the following General Formula (1).

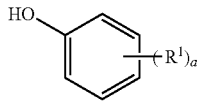

(1)

[In General Formula (1), $R^1$ represents a monovalent group represented by the following General Formula (2), and a is an integer from 1 to 5.

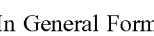

(2)

{In General Formula (2), $R^2$ represents a divalent group represented by the following Formula (3), b represents an integer from 1 to 5, the total number of a×b is in a range of from 1 to 5, and a plurality of b's may be the same as or different from one another when a in Formula (1) is 2 or greater.

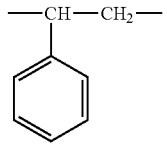

(3)

}]

It is preferable that the cleaning agent composition for hard surface of the present invention further contains (D) a glycol ether.

In the cleaning agent composition for hard surface of the present invention, it is preferable that the content of the carboxylic acid compound is from 1% by mass to 40% by mass, the content of the alkanolamine compound is from 1% by mass to 60% by mass, and the content of the hydroxyl group-containing compound is from 0.01% by mass to 5% by mass based on the entire amount of the cleaning agent composition for hard surface.

Advantageous Effects of Invention

According to the present invention, it is possible to provide a cleaning agent composition for hard surface which exhibits excellent liquid dropping property.

DESCRIPTION OF EMBODIMENTS

The cleaning agent composition for hard surface of the present embodiment contains (A) at least one kind of carboxylic acid compound selected from the group consisting of an aliphatic monocarboxylic acid, a polycarboxylic acid, and any neutralized salt thereof, (B) an alkanolamine compound, and (C) a hydroxyl group-containing compound having from 8 to 50 carbon atoms.

The cleaning agent composition for hard surface of the present embodiment can exhibit excellent liquid dropping property even at normal temperature. This makes it possible to expect energy cost saving when drying the parts after being cleaned.

In addition, the cleaning agent composition for hard surface of the present embodiment can exert sufficient cleaning performance and foam inhibiting property even at normal temperature. This makes it possible to expect energy cost saving as the cleaning step which has been hitherto performed at a high temperature is performed at normal temperature and the cleaning bath is thus not required to be heated. Furthermore, there has been a problem that bubbles hardly disappear as the temperature decreases in the case of the conventional cleaning agents, but the cleaning agent composition for hard surface of the present embodiment can have a property of exhibiting excellent defoaming property even at normal temperature.

Examples of the aliphatic monocarboxylic acid to be used as the component (A) may include a straight-chain or branched-chain unsaturated or saturated aliphatic monocarboxylic acid which has from 6 to 24 carbon atoms and may have a hydroxyl group. Specific examples of such an aliphatic monocarboxylic acid may include caproic acid, caprylic acid, enantoic acid, pelargonic acid, capric acid, lauric acid, myristic acid, palmitic acid, palmitoleic acid, margaric acid, stearic acid, oleic acid, vaccenic acid, linoleic acid, (9,12,15)-linolenic acid, (6,9,12)-linolenic acid, eleostearic acid, arachidic acid, (8,11)-eicosadienoic acid, (5,8,11)-eicosatrienoic acid, arachidonic acid, behenic acid, lignoceric acid, nervonic acid, 2-ethylhexanoic acid, 2-methylhexanoic acid, 2-methylheptanoic acid, trimethylhexanoic acid, isostearic acid, and 12-hydroxystearic acid. These may be used singly or in combination of two or more kinds thereof.

Examples of any neutralized salt of the aliphatic monocarboxylic acid to be used as the component (A) may include neutralized salts obtained by neutralizing the aliphatic monocarboxylic acids described above with an alkali metal and the like. Here, examples of the alkali metal may include sodium, potassium, and lithium. These may be used singly or in combination of two or more kinds thereof.

From the viewpoint of cleaning performance, the aliphatic monocarboxylic acid and any neutralized salt thereof to be used as the component (A) are preferably a straight-chain or branched-chain unsaturated or saturated aliphatic monocarboxylic acid having from 6 to 18 carbon atoms and any neutralized salt thereof and more preferably a straight-chain or branched-chain unsaturated or saturated aliphatic monocarboxylic acid having from 6 to 12 carbon atoms and any neutralized salt thereof. These may be used singly or in combination of two or more kinds thereof.

Examples of the polycarboxylic acid to be used as the component (A) may include a polycarboxylic acid having a weight average molecular weight of from 500 to 150,000. From the viewpoint of cleaning performance and handling property, a polycarboxylic acid having a weight average molecular weight of from 1,000 to 100,000 is preferable and a polycarboxylic acid having a weight average molecular weight of from 1,000 to 50,000 is more preferable. In the present specification, the weight average molecular weight of the polycarboxylic acid means a value to be measured by gel permeation chromatography (GPC).

Examples of the polycarboxylic acid may include homopolymers and copolymers synthesized by employing a conventionally known radical polymerization method using a vinyl monomer having a carboxyl group such as acrylic acid, methacrylic acid, maleic acid, fumaric acid, or itaconic acid. As the polycarboxylic acid, commercially available ones may be used. In the radical polymerization, a copolymerizable monomer which does not have a carboxyl group may be used in addition to the monomer described above in a range in which the effect of the present invention is not impaired. Examples of such a monomer may include a vinyl monomer such as ethylene, vinyl chloride, or vinyl acetate, acrylamide, an acrylate, and a methacrylate. As the acrylate and metbacrylate, those having an alkyl group having from 1 to 3 carbon atoms or an alkenyl group having from 2 to 3 carbon atoms are preferable. These alkyl groups or alkenyl groups may have a substituent such as a hydroxyl group. Examples of such acrylates and methacrylates may include methyl acrylate, methyl methacrylate, ethyl acrylate, ethyl methacrylate, 2-hydroxyethyl acrylate, 2-hydroxyethyl methacrylate, propyl acrylate, and propyl methacrylate. The weight ratio of the vinyl monomer having a carboxyl group to the copolymerizable monomer which does not have a carboxyl group is preferably from 100:0 to 50:50, more preferably from 100:0 to 70:30, and still more preferably from 100:0 to 90:10 from the viewpoint of cleaning performance. These copolymerizable monomers may be used singly or in combination of two or more kinds thereof.

Examples of any neutralized salt of the polycarboxylic acid to be used as the component (A) may include neutralized salts obtained by neutralizing the polycarboxylic acids described above with an alkali metal and the like. Here, examples of the alkali metal may include sodium, potassium, and lithium. These may be used singly or in combination of two or more kinds thereof.

The method of manufacturing the polycarboxylic acid and any neutralized salt thereof is not particularly limited, but examples thereof may include a method in which a radical polymerization initiator is added to the monomer described above and/or an aqueous solution of any salt thereof and the mixture is heated and reacted at from 30° C. to 150° C. for from 2 to 5 hours. At this time, an aqueous solvent such as an alcohol such as methanol, ethanol, or isopropyl alcohol or acetone may be added to the monomer and/or the aqueous solution of any salt thereof. The radical polymerization initiator to be used is also not particularly limited, but examples thereof may include a persulfate such as potassium persulfate, sodium persulfate, or ammonium persulfate, a redox system polymerization initiator by the combination of a persulfate with sodium bisulfite and the like, hydrogen peroxide, and water-soluble azo-based polymerization initiator. These radical polymerization initiators may be used singly or in combination of two or more kinds thereof. At the time of radical polymerization, a chain transfer agent (for example, octyl thioglycolate) may be added for the purpose of adjusting the degree of polymerization.

As the polycarboxylic acid and any neutralized salt thereof to be used as the component (A), a homopolymer of acrylic acid, methacrylic acid, or maleic acid or any neutralized salt thereof or a copolymer containing any one or more kinds of acrylic acid, methacrylic acid, or maleic acid as a monomer component or any neutralized salt thereof is preferable and a homopolymer of acrylic acid or any neutralized salt thereof is more preferable from the viewpoint of cleaning performance. The polycarboxylic acids described above and neutralized salts thereof may be used singly or in combination of two or more kinds thereof.

The amount of the component (A) blended in the cleaning agent composition for hard surface is appropriately set depending on the purpose of use, but it is preferably from 1% by mass to 40% by mass and more preferably from 1% by mass to 20% by mass based on the entire amount of the cleaning agent composition for hard surface from the viewpoint of cleaning performance, rust preventing property, and economic efficiency.

The alkanolamine compound to be used as the component (B) is not particularly limited, but an alkanolamine compound represented by the following General Formula (4) is preferable.

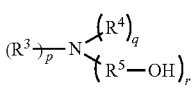

(4)

[In General Formula (4), $R^3$ and $R^4$ each independently represent a hydrogen atom, an alkyl group having from 1 to 22 carbon atoms, an alkenyl group having from 2 to 22 carbon atoms, an aryl group having from 6 to 23 carbon atoms, or an aralkyl group having from 7 to 45 carbon atoms, $R^5$ represents an alkylene group having from 1 to 22 carbon atoms or an aralkylene group having from 7 to 15 carbon atoms, p and q each independently represent 0 or 1, r represents an integer from 1 to 3, and p+q+r is 3.]

Specific examples of the alkanolamine compound represented by General formula (4) above may include a monoalkanolamine compound such as monoethanolamine, N,N-dimethylethanolamine, N,N-diethylethanolamine, N,N-dibutylethanolamine, N-methylethanolamine, N-ethylethanolamine, N-n-butylethanolamine, N-t-butylethanolamine, 2-(diphenylamino)ethanol, 1-phenylaminoethanol, N-benzylethanolamine, N,N-dibenzyl-2-ethanolamine, or monoisopropanolamine; a dialkanolamine compound such as diethanolamine, N-methyldiethanolamine, N-ethyldiethanolamine, N-n-butyldiethanolamine, N-t-butyldiethanolamine, N-benzyldiethanolamine, or diisopropanolamine; and a trialkanolamine compound such as triethanolamine or triisopropanolamine.

From the viewpoint of cleaning performance and rust preventing property, the alkanolamine compound represented by General formula (4) above is preferably an alkanolamine compound represented by General formula (4) above in which $R^3$ is a hydrogen atom, an alkyl group having from 1 to 6 carbon atoms, an alkenyl group having from 2 to 6 carbon atoms, an aryl group having from 6 to 13 carbon atoms, or an aralkyl group having from 7 to 13 carbon atoms, $R^4$ is a hydrogen atom, an alkyl group having from 1 to 6 carbon atoms, an alkenyl group having from 2 to 6 carbon atoms, an aryl group having from 6 to 13 carbon atoms, or an aralkyl group having from 7 to 13 carbon atoms, $R^5$ is an alkylene group having from 1 to 8 carbon atoms or aralkylene group having from 7 to 14 carbon atoms, p is 0 or 1, q is 0 or 1, r is from 1 to 3, and p+q+r is 3 and more preferably an alkanolamine compound represented by General formula (4) above in which $R^5$ is an alkylene group having from 1 to 3 carbon atoms, p and q are 0, and r is 3.

The alkanolamine compounds described above may be used singly or in combination of two or more kinds thereof.

With regard to the blending of the component (B), the component (A) is previously neutralized with a predetermined amount of the component (B) and the rest of the component (B) and the component (C) may be then blended with the mixture, or the entire amount of the component (A), the component (B), and the component (C) may be blended together at once.

The amount of the component (B) blended in the cleaning agent composition for hard surface is appropriately set depending on the purpose of use, but it is preferably from 1% by mass to 60% by mass and more preferably from 1% by mass to 40% by mass based on the entire amount of the cleaning agent composition for hard surface from the viewpoint of cleaning performance, rust preventing property, and economic efficiency.

Examples of the hydroxyl group-containing compound which has from 8 to 50 carbon atoms and is used as the component (C) may include an aliphatic monoalcohol having from 8 to 50 carbon atoms and any phenol derivative which has from 8 to 50 carbon atoms and is represented by the following General Formula (1).

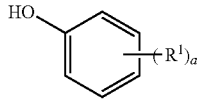

(1)

[In General Formula (1), $R^1$ represents a monovalent group represented by the following General Formula (2), and a is an integer from 1 to 5.

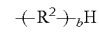

(2)

{in General Formula (2), $R^2$ represents a divalent group represented by the following Formula (3), b represents an integer from 1 to 5, a total number of a×b is in a range of from 1 to 5, and a plurality of b's may be the same as or different from one another when a in Formula (1) is 2 or greater.

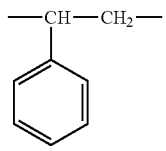

(3)

}]

Examples of the aliphatic monoalcohol having from 8 to 50 carbon atoms may include a straight-chain primary alcohol such as octyl alcohol, decyl alcohol, lauryl alcohol, myristyl alcohol, cetyl alcohol, stearyl alcohol, oleyl alcohol, behenyl alcohol, or tridecyl alcohol; a branched-chain primary alcohol such as 4-butyloctanol, 2-butyldecanol, 2-hexyloctanol, 2-hexyldecanol, 2-octyldodecanol, 2-octyldodecanol, 2-dodecylhexadecanol, 2-tetradecyloctadecanol, isooctanol, 2-ethylhexanol, isononanol, isodecanol, isoundecanol, or isotridecanol; a secondary alcohol such as 2-octanol, 3-octanol, 4-octanol, 2-dodecanol, or 2-tridecanol; and a tertiary alcohol such as 2-methylheptan-2-ol, 2-methyldecan-2-ol, 6-methylundecan-6-ol, or 6-pentylundecan-6-ol.

Examples of the phenol derivative which has from 8 to 50 carbon atoms and is represented by the following General Formula (1) may include monostyrenated phenol, distyrenated phenol, and tristyrenated phenol. Examples of the styrenated phenol may include a compound to be obtained by a known manufacturing method in which a predetermined amount of styrene is reacted (Friedel-Crafts reaction) with a predetermined amount of phenol at a temperature of from 110° C. to 140° C. by using $AlCl_3$, $SbCl_3$, $H_2SO_4$, $H_3PO_4$, activated clay, or the like as a catalyst.

From the viewpoint of cleaning performance, drying property, and defoaming property, the component (C) is preferably an aliphatic monoalcohol having from 8 to 50 carbon atoms, an aliphatic primary alcohol having from 8 to 40 carbon atoms and an aliphatic secondary alcohol having from 8 to 32 carbon atoms are more preferable, a straight-chain aliphatic primary alcohol having from 8 to 18 carbon atoms, an aliphatic primary alcohol having from 8 to 18 carbon atoms and an alkyl group which has from 1 to 3 carbon atoms and is branched at the positions other than the β-position with respect to the $CH_2OH$ group of the straight-chain alkyl group, an aliphatic primary alcohol having from 8 to 40 carbon atoms and a straight-chain alkyl group which has from 1 to 20 carbon atoms and is branched at the β-position with respect to the $CH_2OH$ group of the straight-chain alkyl group (for example, a compound represented by the following General Formula (5)), and an aliphatic secondary alcohol having from 8 to 24 carbon atoms are still more preferable, and an aliphatic primary alcohol having from 8 to 32 carbon atoms and a straight-chain alkyl group which has from 2 to 13 carbon atoms and is branched at the β-position with respect to the $CH_2OH$ group of the straight-chain alkyl group (for example, a compound represented by the following General Formula (5) in which $R^6$ is an alkyl group having from 2 to 13 carbon atoms and $R^7$ is an alkyl group having from 2 to 26 carbon atoms) is particularly preferable. These may be used singly or in combination of two or more kinds thereof.

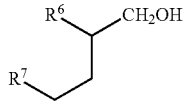

(5)

[In General Formula (5), $R^6$ represents an alkyl group having from 1 to 20 carbon atoms and $R^7$ represents an alkyl group having from 3 to 35 carbon atoms.]

The amount of the component (C) blended in the cleaning agent composition for hard surface is appropriately set depending on the purpose of use, but it is preferably from 0.01% by mass to 5% by mass and more preferably from 0.1% by mass to 3% by mass based on the entire amount of the cleaning agent composition for hard surface from the viewpoint of cleaning performance, drying property, and economic efficiency.

In the cleaning agent composition for hard surface of the present embodiment, the mass ratio among the component (A), the component (B), and the component (C) is preferably (A):(B):(C)=10 to 89.9:10 to 89.9:0.1 to 10 from the viewpoint of cleaning performance, drying property, and defoaming property.

The cleaning agent composition for hard surface of the present embodiment may further contain (D) a glycol ether from the viewpoint of cleaning performance and drying property.

Examples of the glycol ether to be used as the component (D) may include a glycol ether represented by the following General Formula (6).

$$R^8\text{—O-(AO)}_n\text{H} \quad (6)$$

[In General Formula (6), $R^8$ represents an alkyl group having from 1 to 10 carbon atoms, an alkenyl group having from 2 to 10 carbon atoms, an aryl group having from 6 to 10 carbon atoms, or an aralkyl group having from 7 to 10 carbon atoms, AO represents an alkyleneoxy group having from 2 to 4 carbon atoms, and n represents from 1 to 5.]

Specific examples of the glycol ether may include a butyl alcohol AO (1 to 5) adduct, a 2-ethylhexanol AO (1 to 5) adduct, a 1-decanol AO (1 to 5) adduct, a phenol AO (1 to 5) adduct, and a benzyl alcohol AO (1 to 5) adduct. The numerical values in the parentheses indicate the molar number. Incidentally, the alkyleneoxy groups of AO's may be the same as or different from one another in a case in which there are a plurality of AO's (n is 2 or more), and they may be blockwisely, randomly, or alternately added in the case of being different from one another.

Among those described above, a glycol ether represented by General Formula (6) in which $R^8$ is an alkyl group having from 1 to 8 carbon atoms or an alkenyl group having from 2 to 8 carbon atoms, and n is from 1 to 5 is preferable from the viewpoint of cleaning performance and drying property.

The glycol ethers described above may be used singly or in combination of two or more kinds thereof.

The amount of the component (D) blended in the cleaning agent composition for hard surface is appropriately set depending on the purpose of use, but it is preferably from 0.1% by mass to 15% by mass and more preferably from 0.1% by mass to 10% by mass based on the entire amount of the cleaning agent composition for hard surface from the viewpoint of drying property and foam inhibiting property.

It is possible to blend a rust-preventive agent, a defoaming agent, a preservative, a surfactant, a chelating agent, an antioxidant, a coloring agent, a deodorant, a perfuming agent, and the like in the cleaning agent composition for hard surface of the present embodiment in a range in which the effect of the present invention is not impaired.

Examples of the rust-preventive agent may include a dicarboxylic acid, and specific examples thereof may include oxalic acid, malonic acid, succinic acid, glutaric acid, adipic acid, fumaric acid, maleic acid, dodecanedioic acid, eicosadioic acid, isodocosadienoic diacid, isodocosanedioic acid, isoeicosadienoic diacid, butyloctanedioic acid, and dialkoxycarbonylisodocosadienoic diacid. These rust-preventive agents may be used singly or in combination of two or more kinds thereof. Incidentally, it is preferable to blend the rust-preventive agent so as not to exceed the preferred amount of the component (A) blended in the case of using a dicarboxylic acid.

Examples of the defoaming agent may include a silicon-based defoaming agent, a polyglycol-based defoaming agent, a higher alcohol-based defoaming agent, and a mineral oil-based defoaming agent. These defoaming agents may be used singly or in combination of two or more kinds thereof. Incidentally, it is preferable to blend the defoaming agent so as not to exceed the preferred amount of the component (D) blended in a case in which the polyglycol-based defoaming agent overlaps with the component (D). In addition, it is preferable to blend the defoaming agent so as not to exceed the preferred amount of the component (C) blended in a case in which the higher alcohol-based defoaming agent overlaps with the component (C).

Examples of the preservative may include an aromatic carboxylic acid, and specific examples thereof may include benzoic acid, p-toluic acid, p-ethylbenzoic acid, p-isopropylbenzoic acid, p-tert-butylbenzoic acid, xylylic acid, isophthalic acid, terephthalic acid, salicylic acid, cinnamic acid, toluic acid, hemimellitic acid, trimellitic acid, trimesic acid, hydroxybenzoic acid, dihydroxybenzoic acid, and trihydroxybenzoic acid. These preservatives may be used singly or in combination of two or more kinds thereof. Incidentally, it is preferable to blend the preservative so as not to exceed the preferred amount of the component (A) blended in a case in which the aromatic carboxylic acid overlaps with the component (A).

Examples of the surfactant may include a nonionic surfactant such as a higher alcohol alkylene oxide adduct, an alkylphenol alkylene oxide adduct, a fatty acid alkylene oxide adduct, a polyhydric alcohol fatty acid ester alkylene oxide adduct, or a higher alkylamine alkylene oxide adduct, an anionic surfactant such as soap, an alkyl benzene sulfonate salt, a higher alcohol sulfate ester salt, or a polyoxyethylene alkyl ether sulfate salt, and an amphoteric surfactant such as an alkyl amino fatty acid salt or an alkyl betaine. These surfactants may be used singly or in combination of two or more kinds thereof incidentally, it is preferable to blend the surfactant so as not to exceed the preferred amount of the component (D) blended in a case in which the higher alcohol alkylene oxide adduct, the alkylphenol alkylene oxide adduct, or the like overlaps with the component (D).

Examples of the chelating agent may include an aminocarboxylic acid-based chelating agent such as EDTA, NTA, DTPA, HEDTA, or TTHA; and a phosphonic acid-based chelating agent such as HEDP or NTMP. These chelating agents may be used singly or in combination of two or more kinds thereof. Incidentally, it is preferable to blend the chelating agent so as not to exceed the preferred amount of the component (A) blended in a case in which the aminocarboxylic acid-based chelating agent overlaps with the component (A).

The pH of the cleaning agent composition for hard surface of the present embodiment is preferably from 5.0 to 14.0, more preferably from 8.0 to 12.0, and particularly preferably from 8.0 to 11.0 from the viewpoint of cleaning performance and rust preventing property. The pH can be adjusted with an alkali such as sodium hydroxide, potassium hydroxide, sodium carbonate, potassium carbonate, or triethanolamine in a case in which the pH is lower than 5.0. The pH can be adjusted with an acid such as hydrochloric acid, sulfuric acid, lactic acid, formic acid, or citric acid in a case in which the pH exceeds 14.0. These pH adjusting agents may be used singly or in combination of two or more kinds thereof. Incidentally, it is preferable to use the pH adjusting agent so as not to exceed the preferred amount of the component (B) blended in a case in which the alkanolamine compound such as triethanolamine overlaps with the component (B). The pH of the cleaning agent composition for hard surface can be measured by a known method such as a glass electrode method.

The static surface tension and dynamic surface tension of the cleaning agent composition for hard surface of the present embodiment are preferably from 20 to 60 mN/m and more preferably 20 to 50 mN/m from the viewpoint of cleaning performance and drying property. The static surface tension can be measured by the Wilhelmy method, and the dynamic surface tension can be measured by the maximum bubble pressure method.

The hard surface of the target to be cleaned with the cleaning agent composition for hard surface of the present embodiment is not particularly limited as long as it has a hard surface, but examples thereof may include a metal such as iron, aluminum, gold, silver, copper, lead, or titanium; glass such as quartz glass, soda glass, potassium glass, borosilicate glass, or lead glass; an alloy such as a stainless steel and a duralumin and titanium alloy; a plated metal such as brass or zinc-coated steel; a plastic such as polyethylene terephthalate, polyethylene, vinyl chloride, polypropylene, polycarbonate, or polyamide; a ceramic; a mineral such as marble or diamond.

The cleaning agent composition for hard surface of the present embodiment may be used as it is, but a treatment liquid prepared by diluting the composition with water may be used. With regard to the concentration of the treatment liquid, the content of the cleaning agent composition for hard surface is preferably from 0.01% by mass to 50% by mass, more preferably from 0.05% by mass to 30% by mass, and still more preferably from 0.1% by mass to 15% by mass based on the entire amount of the treatment liquid from the viewpoint of cleaning performance and economic efficiency.

It is possible to suitably use tap water, well water, ion exchanged water, or distilled water as the water in the present embodiment.

The pH of the treatment liquid prepared by diluting the cleaning agent composition for hard surface with water is preferably from 5.0 to 14.0, more preferably from 8.0 to 12.0, and still more preferably from 8.0 to 11.0 from the viewpoint of cleaning performance and rust preventing property. The pH can be adjusted with an alkali such as sodium hydroxide, potassium hydroxide, sodium carbonate, potassium carbonate, or triethanolamine in a case in which the pH is lower than 5.0. The pH can be adjusted with an acid such as hydrochloric acid, sulfuric acid, lactic acid, formic acid, or citric acid in a case in which the pH exceeds 14.0. These pH adjusting agents may be used singly or in combination of two or more kinds thereof. Incidentally, it is preferable to use the pH adjusting agent so as not to exceed the preferred amount of the component (B) blended in a case in which the alkanolamine compound such as triethanolamine overlaps with the component (B). The pH of the treatment liquid can be measured by a known method such as a glass electrode method.

The static surface tension and dynamic surface tension of the treatment liquid prepared by diluting the cleaning agent composition for hard surface with water are preferably from 20 to 60 mN/m and more preferably 20 to 50 mN/m from the viewpoint of cleaning performance and drying property. The static surface tension of the treatment liquid can be measured by the Wilhelmy method, and the dynamic surface tension thereof can be measured by the maximum bubble pressure method.

The cleaning method using the cleaning agent composition for hard surface of the present embodiment is not particularly limited, but the cleaning agent composition for hard surface is suitably used in a cleaning method which additionally includes a physical operation, such as an ultrasonic method, a spraying method, a bubbling method, a barreling method, or a dipping and shaking method.

The cleaning temperature is preferably from 5° C. to 100° C., more preferably from 10° C. to 80° C., and particularly preferably from 15° C. to 80° C. from the viewpoint of cleaning performance and economic efficiency. The cleaning time can be appropriately set depending on the shape and size of the material to be cleaned, the cleaning method, and the cleaning condition.

EXAMPLES

Hereinafter, the present invention will be described in more detail with reference to Examples, but the present invention is not limited by these Examples at all.

Examples 1 to 15 and Comparative Examples 1 to 5

The cleaning agent compositions for hard surface of Examples 1 to 15 and Comparative Examples 1 to 5 were prepared in accordance with the components and compositions (% by mass) presented in Tables 1 to 4. Specifically, the component (A) and the component (B) were added to the ion exchanged water (F), the component (E) was further added thereto in the case of Example 15 and Comparative Example 2 and Comparative Example 3, they were mixed together until to be uniform, the component (C) and component (D) were further added to the mixture, and they were mixed together to prepare the cleaning agent compositions for hard surface. Cleaning agents for hard surface were prepared by diluting the cleaning agent compositions for hard surface of Examples 1 to 15 and Comparative Examples 1 to 5 thus obtained with ion exchanged water to have a concentration of 3% by mass and subjected to the following tests for evaluation.

[Test for Evaluation on Cleaning Performance]

A commercially available cold-rolled steel sheet (hereinafter referred to as SPCC-SB) which had been cut into 50 mm×50 mm×1 mm was used as a test piece. The surface of the test piece was cleaned with n-hexane, and coated with 0.2 g of rust-preventive oil (ANTIRUST P2800 manufactured by JXTG Nippon Oil & Energy Corporation) as a contaminant to prepare a contaminated sample.

For cleaning, each of the cleaning agents for hard surface of Examples 1 to 16 and Comparative Examples 1 to 5 was filled in an ultrasonic cleaning machine (BRANDONIC B2200 manufactured by Emerson Japan, Ltd.), the temperature of the cleaning agent for hard surface was adjusted to 25° C. or 60° C., and the contaminated sample was then dipped in the cleaning agent for hard surface and subjected to ultrasonication for 2 minutes. Thereafter, the test piece was pulled up therefrom and dried at 80° C. for 30 minutes. The cleaning rate was calculated by the following equation.

Cleaning rate (% by mass)=[{weight of contaminated sample before being cleaned (g)}−{weight of contaminated sample after being cleaned (g))}]×100/[{weight of contaminated sample before being cleaned (g)}−{weight of test piece (g)}]

[Test for Evaluation on Residual Liquid Amount]

SPCC-SB was used as a test piece. The surface of the test piece was cleaned with n-hexane and dipped in each of the cleaning agents for hard surface of Examples 1 to 15 and Comparative Examples 1 to 5 adjusted to a temperature of 25° C. or 60° C. for 1 minute, the test piece was then pulled up therefrom perpendicularly to the liquid surface, and the amount of liquid remaining on the surface of the test piece was calculated by the following equation. The residual liquid amount was used as the measure of drying property since the surface dried faster as the residual liquid amount was smaller.

Residual liquid amount ($g/m^2$)=[{(weight of test piece after test (g)}−{weight of test piece before test (g)}]/surface area of test piece ($m^2$)

[Test for Evaluation on Foam Inhibiting Property and Defoaming Property]

The amount of foam (mL) on the liquid surface was measured immediately and in 1 minute after 50 ml of each of the cleaning agents for hard surface of Examples 1 to 16 and Comparative Examples 1 to 5 adjusted to a predetermined temperature (25° C. or 60° C.) was poured into a 100 ml Nessler tube and the Nessler tube was swung up and down ten times for 5 seconds with an amplitude width of 20 cm and left on a horizontal table to stand still.

Incidentally, the following compounds were used as the polycarboxylic acid Na*1 and polycarboxylic acid Na*2 in Tables 1 to 4.

*1: Sodium polyacrylate, weight average molecular weight: 6,000.

*2: Sodium polyacrylate, weight average molecular weight: 20,000.

TABLE 1

| | | | Example 1 | Example 2 | Example 3 | Example 4 | Example 5 |
|---|---|---|---|---|---|---|---|
| Component (A) | Caprylic acid | | 8 | 8 | 8 | 8 | 8 |
| | Polycarboxylic acid Na*1 | | 1 | | 1 | 1 | 1 |
| | Polycarboxylic acid Na*2 | | | 1 | | | |
| Component (B) | Triethanolamine | | 25 | 25 | 25 | 25 | |
| | Monoethanolamine | | | | | | 10.5 |
| Component (C) | Tridecyl alcohol | | 0.5 | 0.5 | 0.1 | 3 | 0.5 |
| Component (D) | Butyl glycol | | 4 | 4 | 4 | 4 | 4 |
| Component (E) | Potassium hydroxide | | | | | | |
| Component (F) | Ion exchanged water | | Remainder | Remainder | Remainder | Remainder | Remainder |
| Sum | | | 100 | 100 | 100 | 100 | 100 |
| pH of cleaning agent composition for hard surface | | | 8.6 | 8.6 | 8.6 | 8.6 | 8.6 |
| (A):(B):(C) | | | 26:72:1 | 26:72:1 | 26.4:73.3:0.3 | 24:68:8 | 45:53:3 |
| Cleaning rate (% by mass) | | 60° C. | 91 | 92 | 88 | 94 | 85 |
| | | 25° C. | 71 | 71 | 68 | 74 | 68 |
| Residual liquid amount ($g/m^2$) | | 60° C. | 9 | 9 | 10 | 9 | 12 |
| | | 25° C. | 10 | 10 | 11 | 9 | 15 |

TABLE 1-continued

| | | Example 1 | Example 2 | Example 3 | Example 4 | Example 5 |
|---|---|---|---|---|---|---|
| Amount of foam (immediately after leaving | 60° C. | 11 | 12 | 13 | 10 | 13 |
| cleaning agent for hard surface to stand still) (ml) | 25° C. | 12 | 12 | 13 | 10 | 13 |
| Amount of foam (in 1 minute after leaving | 60° C. | 7 | 7 | 8 | 6 | 8 |
| cleaning agent for hard surface to stand still) (ml) | 25° C. | 8 | 8 | 9 | 7 | 9 |

TABLE 2

| | | | Example 6 | Example 7 | Example 8 | Example 9 | Example 10 |
|---|---|---|---|---|---|---|---|
| Component (A) | Caprylic acid | | 8 | 8 | 8 | 8 | 8 |
| | Polycarboxylic acid Na*1 | | 1 | 1 | 1 | 1 | 1 |
| | Polycarboxylic acid Na*2 | | | | | | |
| Component (B) | Triethanolamine | | 25 | 25 | 25 | 25 | 25 |
| | Monoethanolamine | | | | | | |
| Component (C) | Oleyl alcohol | | 0.5 | | | | |
| | Isodecanol | | | 0.5 | | | |
| | Isostearyl alcohol | | | | 0.5 | | |
| | 2-Ethylhexanol | | | | | 0.5 | |
| | 2-Hexyldodecanol | | | | | | 0.5 |
| Component (D) | Butyl glycol | | 4 | 4 | 4 | 4 | 4 |
| Component (E) | Potassium hydroxide | | | | | | |
| Component (F) | Ion exchanged water | | Remainder | Remainder | Remainder | Remainder | Remainder |
| Sum | | | 100 | 100 | 100 | 100 | 100 |
| pH of cleaning agent composition for hard surface | | | 8.6 | 8.6 | 8.6 | 8.6 | 8.6 |
| (A):(B):(C) | | | 26:72:1 | 26:72:1 | 26:72:1 | 26:72:1 | 26:72:1 |
| Cleaning rate (% by mass) | | 60° C. | 92 | 93 | 92 | 94 | 94 |
| | | 25° C. | 72 | 71 | 72 | 74 | 75 |
| Residual liquid amount (g/m$^2$) | | 60° C. | 9 | 9 | 9 | 9 | 9 |
| | | 25° C. | 10 | 10 | 10 | 10 | 10 |
| Amount of foam (immediately after leaving cleaning | | 60° C. | 11 | 11 | 11 | 10 | 10 |
| agent for hard surface to stand still) (ml) | | 25° C. | 12 | 12 | 12 | 10 | 10 |
| Amount of foam (in 1 minute after leaving cleaning | | 60° C. | 7 | 7 | 7 | 6 | 7 |
| agent for hard surface to stand still) (ml) | | 25° C. | 9 | 8 | 9 | 7 | 7 |

TABLE 3

| | | | Example 11 | Example 12 | Example 13 | Example 14 | Example 15 |
|---|---|---|---|---|---|---|---|
| Component (A) | Caprylic acid | | 8 | 8 | 8 | 8 | 22.2 |
| | Polycarboxylic acid Na*1 | | 1 | 1 | 1 | 1 | 2.8 |
| | Polycarboxylic acid Na*2 | | | | | | |
| Component (B) | Triethanolamine | | 25 | 25 | 25 | 25 | 9 |
| | Monoethanolamine | | | | | | |
| Component (C) | Tridecyl alcohol | | | | | | 0.5 |
| | 2-Tetradecyloctadecanol | | 0.5 | | | | |
| | 2-Dodecanol | | | 0.5 | | | |
| | 6-Dodecanol | | | | 0.5 | | |
| | Tristyrenated phenol | | | | | 0.5 | |
| Component (D) | Butyl glycol | | 4 | 4 | 4 | 4 | 4 |
| Component (E) | Potassium hydroxide | | | | | | 9 |
| Component (F) | Ion exchanged water | | Remainder | Remainder | Remainder | Remainder | Remainder |
| Sum | | | 100 | 100 | 100 | 100 | 100 |
| pH of cleaning agent composition for hard surface | | | 8.6 | 8.6 | 8.6 | 8.6 | 8.6 |
| (A):(B):(C) | | | 26:72:1 | 26:72:1 | 26:72:1 | 26:72:1 | 72:26:1 |
| Cleaning rate (% by mass) | | 60° C. | 93 | 92 | 92 | 86 | 93 |
| | | 25° C. | 74 | 72 | 72 | 68 | 73 |
| Residual liquid amount (g/m$^2$) | | 60° C. | 9 | 9 | 9 | 11 | 12 |
| | | 25° C. | 10 | 10 | 10 | 15 | 15 |
| Amount of foam (immediately after leaving cleaning | | 60° C. | 10 | 10 | 10 | 12 | 13 |
| agent for hard surface to stand still) (ml) | | 25° C. | 10 | 10 | 10 | 12 | 12 |
| Amount of foam (in 1 minute after leaving cleaning | | 60° C. | 6 | 6 | 6 | 8 | 8 |
| agent for hard surface to stand still) (ml) | | 25° C. | 7 | 7 | 7 | 10 | 10 |

TABLE 4

| | | | Comparative Example 1 | Comparative Example 2 | Comparative Example 3 | Comparative Example 4 | Comparative Example 5 |
|---|---|---|---|---|---|---|---|
| Component (A) | Caprylic acid | | 8 | | 8 | 8 | 8 |
| | Polycarboxylic acid Na*1 | | 1 | | 1 | 1 | 1 |
| | Polycarboxylic acid Na*2 | | | | | | |
| Component (B) | Triethanolamine | | 25 | 25 | | 25 | 25 |
| | Monoethanolamine | | | | | | |
| Component (C) | Tridecyl alcohol | | | 0.5 | 0.5 | | |
| | n-Propanol | | | | | 0.5 | |
| | 4-Heptanol | | | | | | 0.5 |
| Component (D) | Butyl glycol | | 4 | 4 | 4 | 4 | 4 |
| Component (E) | Potassium hydroxide (48%) | | | | 6.5 | | |
| | Sulfuric acid (75%) | | | 0.6 | | | |
| Component (F) | Ion exchanged water | | Remainder | Remainder | Remainder | Remainder | Remainder |
| Sum | | | 100 | 100 | 100 | 100 | 100 |
| pH of cleaning agent composition for hard surface | | | 8.6 | 9.5 | 9.5 | 8.6 | 8.6 |
| (A):(B):(C) | | | 26:74:0 | 0:98:2 | 95:0:5 | 26:74:0 | 26:74:0 |
| Cleaning rate (% by mass) | | 60° C. | 75 | 62 | 84 | 85 | 85 |
| | | 25° C. | 55 | 50 | 67 | 64 | 64 |
| Residual liquid amount (g/m$^2$) | | 60° C. | 25 | 20 | 20 | 23 | 24 |
| | | 25° C. | 26 | 23 | 21 | 25 | 25 |
| Amount of foam (immediately after leaving | | 60° C. | 20 | 9 | 13 | 13 | 13 |
| cleaning agent for hard surface to stand still) (ml) | | 25° C. | 15 | 10 | 13 | 13 | 12 |
| Amount of foam (in 1 minute after leaving | | 60° C. | 13 | 4 | 7 | 7 | 7 |
| cleaning agent for hard surface to stand still) (ml) | | 25° C. | 10 | 5 | 8 | 9 | 8 |

As presented in Tables 1 to 3, it has been confirmed that the cleaning agent compositions of Examples 1 to 15 exhibit excellent liquid dropping property as the residual liquid is little under any cleaning condition of 25° C. or 60° C. and also exhibit excellent cleaning performance, foam inhibiting property, and defoaming property.

INDUSTRIAL APPLICABILITY

According to the present invention, it is possible to provide a cleaning agent composition which exhibits excellent liquid dropping property and favorable cleaning performance, foam inhibiting property, and defoaming property even when being used for cleaning a hard surface at normal temperature. This makes it possible to expect energy cost saving as the cleaning step which has been hitherto performed at a high temperature is performed at normal temperature and the cleaning bath is thus not required to be heated.

The invention claimed is:

1. A cleaning agent composition for hard surface consisting of:

(A) at least one kind of carboxylic acid compound selected from the group consisting of a caprylic acid and any neutralized salt of caprylic acid, and at least one kind of carboxylic acid selected from the group consisting of a polycarboxylic acid having a weight average molecular weight from 1,000 to 100,000 and any neutralized salt of a polycarboxylic acid having a weight average molecular weight from 1,000 to 100,000;

(B) an alkanolamine compound;

(C) an aliphatic primary alcohol of General Formula (5)

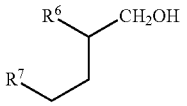

(5)

wherein $R^6$ is an alkyl group having from 1 to 20 carbon atoms, and $R^7$ is an alkyl group having from 3 to 35 carbon atoms, and optionally one or more of the following:

(D) a glycol ether, (E) water, (F) a rust-preventive agent that is a dicarboxylic acid, (G) a defoaming agent selected from a silicon-based defoaming agent, a polyglycol-based defoaming agent, a higher alcohol-based defoaming agent, and a mineral oil-based defoaming agent, (H) a preservative that is an aromatic carboxylic acid, (I) a surfactant selected form a higher alcohol alkylene oxide adduct, an alkylphenol alkylene oxide adduct, a fatty acid alkylene oxide adduct, a polyhydric alcohol fatty acid ester alkylene oxide adduct, or a higher alkylamine alkylene oxide adduct, an alkyl benzene sulfonate salt, a higher alcohol sulfate ester salt, a polyoxyethylene alkyl ether sulfate salt, an alkyl amino fatty acid salt, and an alkyl betaine, (J) a chelating agent selected from an aminocarboxylic acid-based chelating agent and a phosphonic acid-based chelating agent, (K) a pH adjusting agent selected from an alkali and an acid, (L) an antioxidant, (M) a coloring agent, (N) a deodorant, and (O) a perfuming agent.

2. The cleaning agent composition for hard surface according to claim 1, further comprising (D) a glycol ether.

3. The cleaning agent composition for hard surface according to claim 2, wherein a content of the carboxylic acid compound is from 1% by mass to 40% by mass, a content of the alkanolamine compound is from 1% by mass to 60% by mass, a content of the hydroxyl group-containing compound is from 0.01% by mass to 5% by mass, and a content of the glycol ether is from 0.1% by mass to 15% by mass based on the entire amount of the cleaning agent composition for hard surface.

4. The cleaning agent composition for hard surface according to claim 2, wherein the carboxylic acid compound is a straight-chain or branched-chain unsaturated or saturated aliphatic monocarboxylic acid having from 6 to 12 carbon atoms or any neutralized salt thereof.

5. The cleaning agent composition for hard surface according to claim 4, wherein the alkanolamine compound is triethanolamine.

6. The cleaning agent composition for hard surface according to claim 2, wherein the carboxylic acid is a caprylic acid.

7. The cleaning agent composition for hard surface according to claim 2, wherein the alkanolamine compound is triethanolamine.

8. The cleaning agent composition for hard surface according to claim 2, wherein the glycol ether is a butyl glycol.

9. The cleaning agent composition for hard surface according to claim 1, wherein a content of the carboxylic acid compound is from 1% by mass to 40% by mass, a content of the alkanolamine compound is from 1% by mass to 60% by mass, and a content of the hydroxyl group-containing compound is from 0.01% by mass to 5% by mass based on the entire amount of the cleaning agent composition for hard surface.

10. The cleaning agent composition for hard surface according to claim 3, wherein the carboxylic acid compound is a straight-chain or branched- chain unsaturated or saturated aliphatic monocarboxylic acid having from 6 to 12 carbon atoms or any neutralized salt thereof.

11. The cleaning agent composition for hard surface according to claim 10, wherein the alkanolamine compound is triethanolamine.

12. The cleaning agent composition for hard surface according to claim 1, wherein the carboxylic acid is a caprylic acid.

13. The cleaning agent composition for hard surface according to claim 1, wherein the alkanolamine compound is triethanolamine.

* * * * *